US009394069B2

(12) United States Patent
Smith et al.

(10) Patent No.: US 9,394,069 B2
(45) Date of Patent: Jul. 19, 2016

(54) CORNER PROTECTOR PLACEMENT SYSTEM AND METHOD AND RELATED PALLET WRAPPING SYSTEM AND METHOD

(71) Applicants: Jeffery G. Smith, Alexandria, MN (US); Ricky S. Sprouls, Nelson, MN (US)

(72) Inventors: Jeffery G. Smith, Alexandria, MN (US); Ricky S. Sprouls, Nelson, MN (US)

(73) Assignee: BRENTON LLC, Alexandria, MN (US)

( * ) Notice: Subject to any disclaimer, the term of this patent is extended or adjusted under 35 U.S.C. 154(b) by 910 days.

(21) Appl. No.: 13/630,969

(22) Filed: Sep. 28, 2012

(65) Prior Publication Data

US 2013/0081360 A1 Apr. 4, 2013

Related U.S. Application Data

(60) Provisional application No. 61/541,445, filed on Sep. 30, 2011.

(51) Int. Cl.

| | |
|---|---|
| ***B65B 13/18*** | (2006.01) |
| ***B65B 11/02*** | (2006.01) |
| ***B65B 61/22*** | (2006.01) |
| ***B65B 51/04*** | (2006.01) |
| ***B65D 81/05*** | (2006.01) |

(52) U.S. Cl.

CPC ..... *B65B 13/181* (2013.01); *B65B 11/025* (2013.01); *B65B 2210/20* (2013.01)

(58) Field of Classification Search

CPC ..... B65B 13/181; B65B 61/22; B65B 51/02; B65B 51/04; B65D 81/053; B65D 81/054

USPC ..... 53/397, 399, 410, 441, 139.7, 556, 580, 53/587–589; 206/586

See application file for complete search history.

(56) References Cited

U.S. PATENT DOCUMENTS

| | | | | |
|---|---|---|---|---|
| 2,995,863 | A * | 8/1961 | Bright | A45C 13/36 190/37 |
| 4,878,334 | A | 11/1989 | Quinn | |
| 4,897,980 | A * | 2/1990 | Geyser | B65B 5/028 53/128.1 |
| 5,226,280 | A | 7/1993 | Scherer et al. | |
| 5,535,572 | A | 7/1996 | Morantz et al. | |
| 5,546,730 | A | 8/1996 | Newell et al. | |
| 5,564,254 | A | 10/1996 | Thimon et al. | |
| 5,619,838 | A | 4/1997 | Kasel | |
| 5,899,046 | A | 5/1999 | Hughes | |
| 6,508,044 | B2 | 1/2003 | Suolahti | |
| 6,883,293 | B2 | 4/2005 | Lancaster, III et al. | |
| 7,213,381 | B2 | 5/2007 | Ziella et al. | |
| 7,325,371 | B2 | 2/2008 | Cere' | |
| 2003/0029552 | A1 * | 2/2003 | Parcels | B65B 61/22 156/212 |
| 2004/0216425 | A1 | 11/2004 | Morton et al. | |

FOREIGN PATENT DOCUMENTS

| | | |
|---|---|---|
| WO | WO 2009/139686 | 11/2009 |

* cited by examiner

*Primary Examiner* — Andrew M Tecco
*Assistant Examiner* — Praachi M Pathak
(74) *Attorney, Agent, or Firm* — Thompson Hine LLP

(57) ABSTRACT

A stretch film wrapping system for wrapping film about palletized loads includes a wrapping station for wrapping stretch film about a palletized load. A corner protector placement station is located upstream of the wrapping station along a path of a conveying system leading from the corner protector placement station to the wrapping station. Corner protectors are applied to the corner edges of a palletized load at the corner protector placement station, prior to delivering the palletized load to the wrapping station. The corner protector placement station may include a pair of robotic arms that pick corner protectors, position them for application of an adhesive and then apply the protectors to the corner edges of the palletized load.

12 Claims, 6 Drawing Sheets

CORNER PROTECTOR PLACEMENT SYSTEM AND METHOD AND RELATED PALLET WRAPPING SYSTEM AND METHOD

CROSS-REFERENCE

This application claims the benefit of U.S. Provisional Application Ser. No. 61/541,445, filed Sep. 30, 2011.

TECHNICAL FIELD

The present application relates to a system and method for applying corner protectors to the vertical corner edges of palletized loads prior to wrapping the palletized load in stretch wrap film.

BACKGROUND

Palletized loads are typically wrapped in plastic stretch film prior to shipping to stabilize the load on the pallet and prevent product shifting off of the pallet during transport. Corner protectors are often placed on the four vertical corner edges of the palletized load for added stability. The corner protectors are commonly applied at the film wrapping station and are held in place by positive mechanical action pushing the corner protector against the corner of the load until the film is at least partly wrapped around part of the corner protector, at which point the positive mechanical action can be removed without resulting in the corner board falling away from the load.

It would be desirable to provide a system and method that eliminates the need for the positive mechanical action during the initial phase of the film wrap about the palletized load.

SUMMARY

In one aspect, a stretch film wrapping system for wrapping film about palletized loads includes a wrapping station for wrapping stretch film about a palletized load. A corner protector placement station is located upstream of the wrapping station along a path of a conveying system leading from the corner protector placement station to the wrapping station. Corner protectors are applied to the corner edges of a palletized load at the corner protector placement station, prior to delivering the palletized load to the wrapping station.

In the stretch film wrapping system of the immediately preceding paragraph, the corner protector placement station may includes a first robotic arm at a first side of the path; a second robotic arm at a second side of the path; a first supply of corner protectors located for picking by the first robotic arm; a second supply of corner protectors located for picking by the second robotic arm; a first adhesive applicator at the first side of the path; and a second adhesive applicator at the second side of the path.

The stretch film wrapping system of the immediately preceding paragraph may further include: the first robotic arm including a detection apparatus; the second robotic arm including a detection apparatus; and a control system configured to control the conveying system, first robotic arm, second robotic arm, first adhesive applicator and second adhesive applicator such that:

(a) the conveying system moves a palletized load into a first corner protector placement location and:

(i) a first downstream corner of the palletized load is identified, adhesive is applied to a first corner protector and the first corner protector is applied to the first downstream corner;

(ii) a second downstream corner of the palletized load is identified, adhesive is applied to a second corner protector and the second corner protector is applied to the second downstream corner; and (b) the conveying system moves the palletized load with first and second corner protectors adhered thereto into a second corner protector placement location, downstream of the first corner protector placement location, and:

(i) a first upstream corner of the palletized load is identified, glue is applied to a third corner protector and the third corner protector is applied to the first upstream corner;

(ii) a second upstream corner of the palletized load is identified, glue is applied to a fourth corner protector and the fourth corner protector is applied to the second upstream corner.

In one example, the first corner protector placement location may be slightly upstream of the first and second robotic arms and the second corner protector placement station may slightly downstream of the first and second robotic arms.

In one implementation, the first and second adhesive applicators may be hot melt glue applicators.

In another aspect, a method of applying corner protectors to a palletized load involves: (a) locating a corner protector placement station upstream of a film wrapping station; (b) moving a palletized load into the corner protector placement station where a corner protector is applied to each corner of the palletized load and secured thereto via an adhesive; and (c) moving the palletized load with corner protectors adhered thereto out of the corner protector placement station and toward the film wrapping station.

In the method of the preceding paragraph step (b) may involves: utilizing at least one robotic arm at the corner protector placement station to pick a corner protector, identify a corner edge of the palletized load, position the corner protector proximate an adhesive applicator as adhesive is applied and move the corner protector with applied adhesive into contact with the identified corner edge of the palletized load.

In the method of the preceding paragraph step (b) may involve:

(b1) moving the palletized load into a first corner protector placement location and:

(i) using a first robotic arm to identify a first downstream corner edge of the palletized load, position a first corner protector proximate a first adhesive applicator as adhesive is applied to the first corner protector and move the first corner protector with applied adhesive into contact with the identified first downstream corner edge of the palletized load;

(ii) using a second robotic arm to identify a second downstream corner edge of the palletized load, position a second corner protector proximate a second adhesive applicator as adhesive is applied to the second corner protector and move the second corner protector with applied adhesive into contact with the identified second downstream corner edge of the palletized load; and (b2) subsequent to step (b1), moving the palletized load into a second corner protector placement location that is downstream of the first corner protector placement location and:

(i) using the first robotic arm to identify a first upstream corner edge of the palletized load, position a third corner protector proximate the first adhesive applicator as adhesive is applied to the third corner protector and move the third corner protector with applied adhesive into contact with the identified first upstream corner edge of the palletized load;

(ii) using the second robotic arm to identify a second upstream corner edge of the palletized load, position a fourth corner protector proximate the second adhesive applicator as adhesive is applied to the fourth corner protector and move the fourth corner protector with applied adhesive into contact with the identified second upstream corner edge of the palletized load.

In one implementation, step (b1)(i) takes place substantially simultaneously with step (b1)(ii); and step (b2)(i) takes place substantially simultaneously with step (b2)(ii).

DETAILED DESCRIPTION

Figure 1:
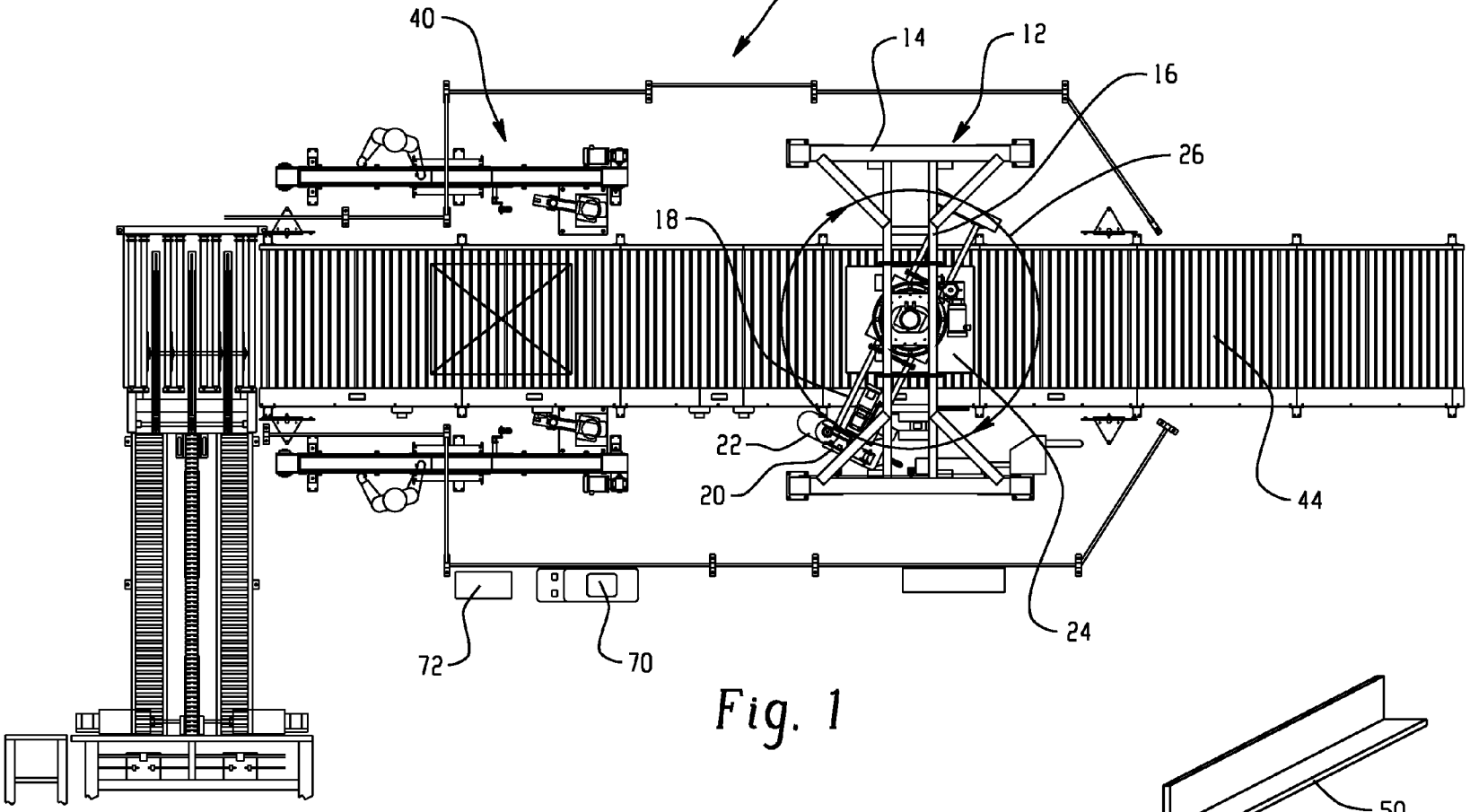
FIG. 1 is a top plan view of a palletized load wrapping system.
Figure 2:
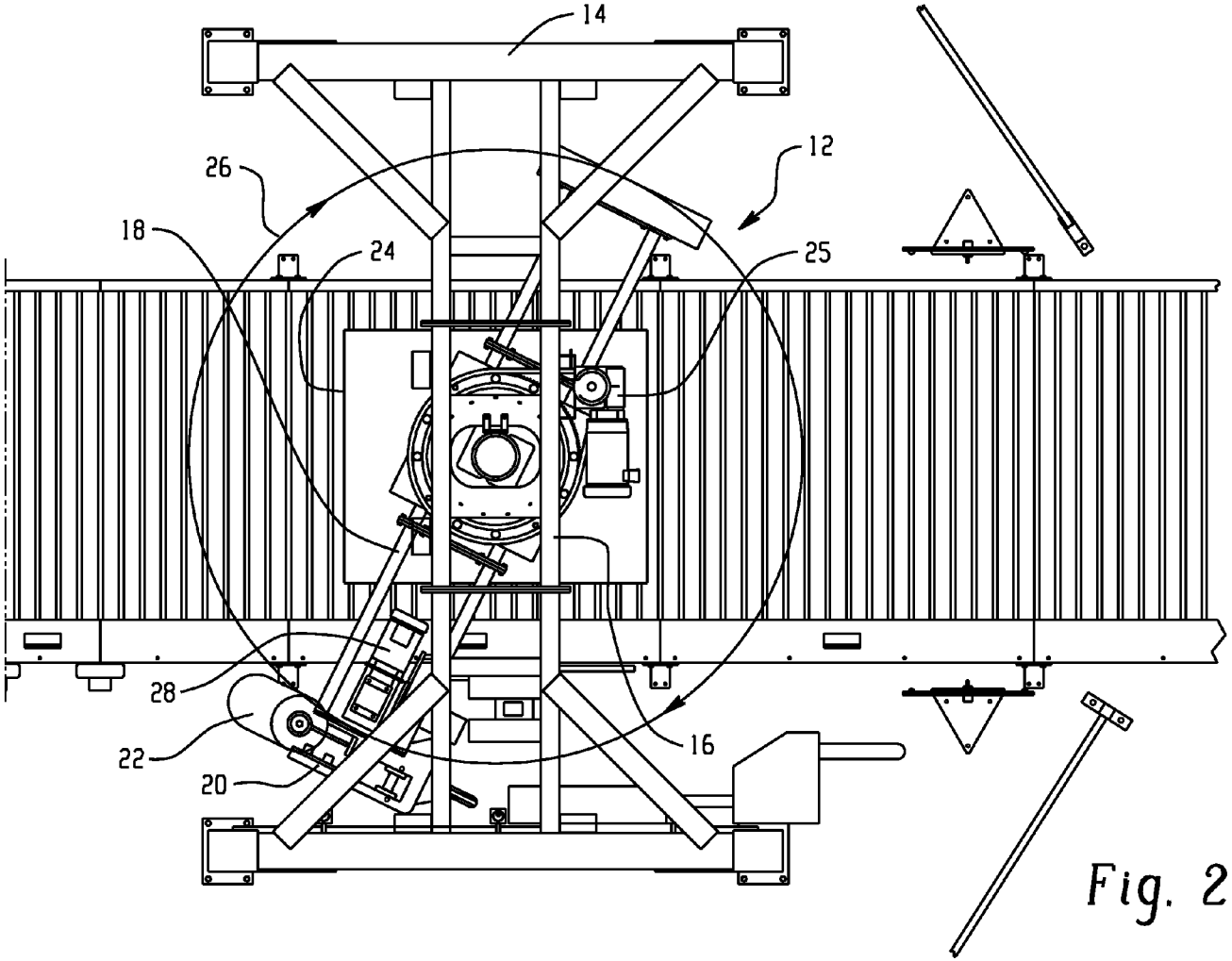
FIG. 2 is an enlarged partial top plan view of the wrapping station of the system of FIG. 1.

Referring to FIG. 1, a plan layout of a film wrapping system 10 for palletized loads is shown. A stretch film wrapping station 12, also shown in the enlarged partial view of FIG. 2, includes a frame 14 with an overhead gantry section 16 from which a film wrapping mechanism 18 is suspended. The mechanism 18 includes a downwardly hanging arm 20 with an associated supply (e.g., a roll) of stretch wrap film 22. An exemplary palletized load 24 is shown centered beneath the mechanism 18. The mechanism is operated by a drive unit 25 (e.g., a motor and belt or chain system) in a rotating manner to move the arm 20 in a circular path 26 multiple times to wrap film about the load 24, which remains stationary during the wrapping process. In the illustrated embodiment, the arm is moved in a clockwise manner (relative to the top views of FIGS. 1 and 2). As the arm 20 moves in the circular path 26, the film supply 22 is moved vertically up and down along the arm 20 (e.g., via a drive unit 28) so that the full height of the palletized load is wrapped during arm rotation. In an alternative embodiment, the palletized load could be rotated and the stretch film applicator could be stationary.

Figure 3:
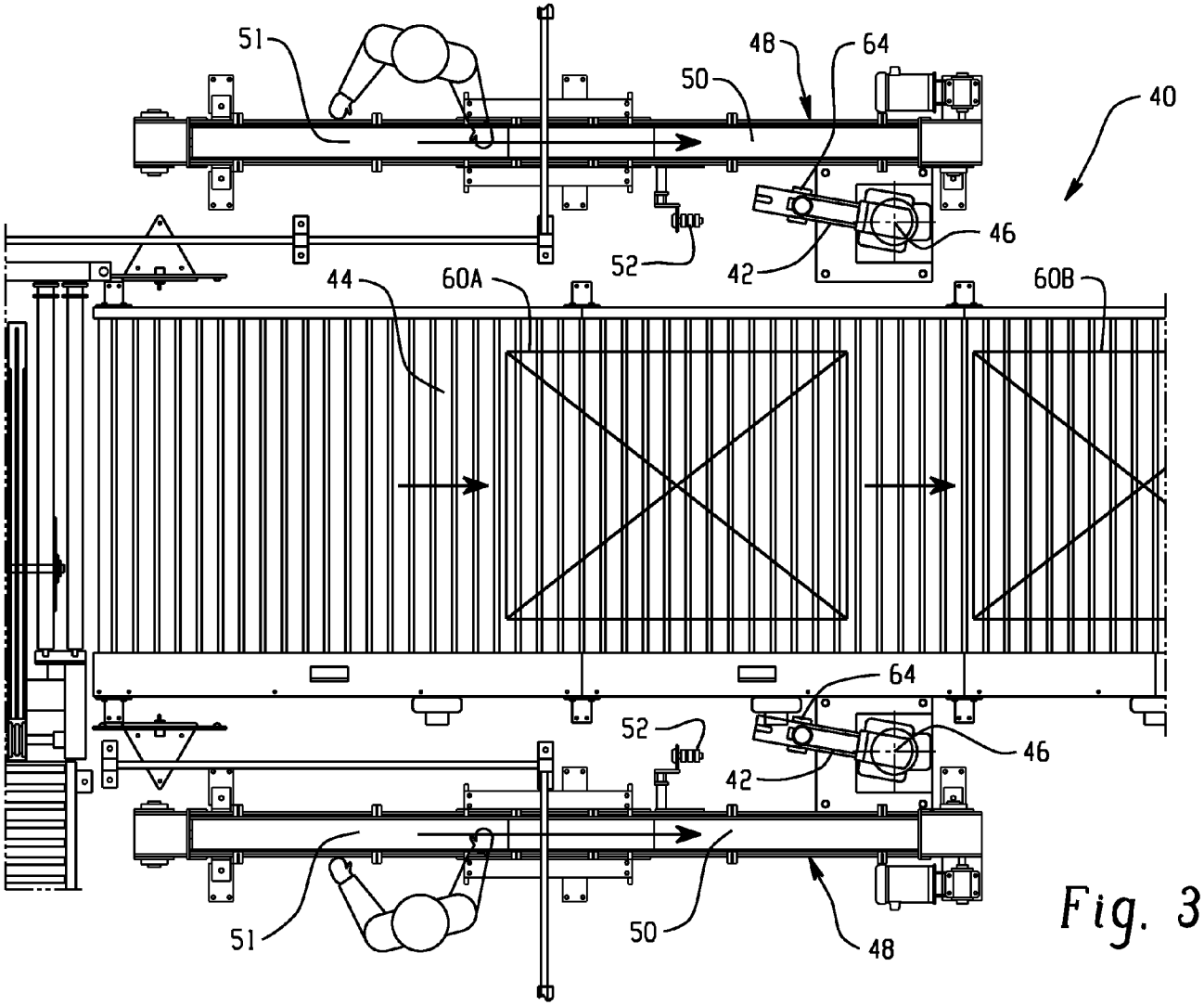
FIG. 3 is an enlarged top plan view of the corner protector placement station of the system of FIG. 1.
Figure 5:
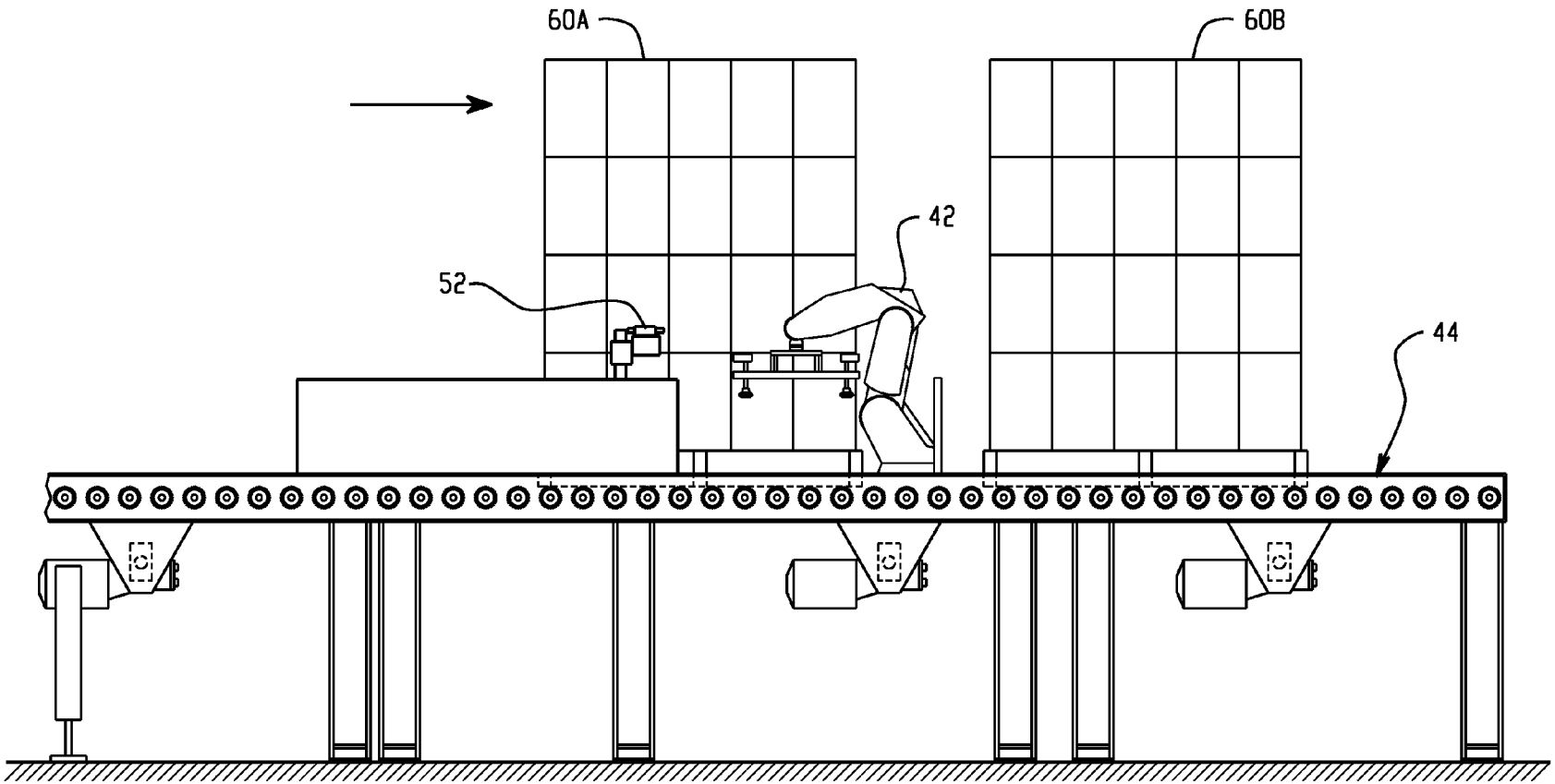
FIG. 5 is a partial side elevation view of the corner protector placement station of the system of FIG. 1.

As seen in FIG. 1, a corner protector placement station 40 is located upstream of the wrapping station 12. The corner protector placement station 40, also shown in the enlarged partial view of FIG. 3, includes a robotic arm 42 along each side of the pallet conveyor 44. Each robotic arm 42 is rotatable about a respective vertical axis 46 and may be formed of multiple pivotally linked sections to allow for articulated movement of the arm and a gripping/picking mechanism at the end of the arm 42. By way of example, the robotic arms may be LR Mate® 200iC Series units available from FANUC Robotics America. Each robotic arm also includes a corner detection system mounted thereon for detecting the vertical corner edges of the pallet loads. By way of example, the LR Mate® 200iC Series units are available with FANUC's iRVision® technology that supports mounting of a single camera for 2D vision, multiple cameras for 3D vision or even a 3DL Sensor that projects lasers for detection 3D position.

Figure 4:
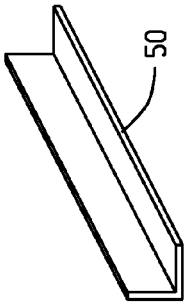
FIG. 4 is a perspective view of an exemplary corner protector.

Each robotic arm 42 is positioned adjacent a respective supply 48 of corner edge protectors, which may typically take the form of an elongated angular member 50 such as that depicted in FIG. 4. That material used for the corner protector can vary according to the needs of the load, but common materials include fiber board, wood, plastic or metal. In the illustrated embodiment, the protectors 50 in each supply 48 are oriented horizontally and arranged in a stack such that the top most protector 50 awaits pick-up by the robotic arm 42. Operator stations 51 are provided for loading of additional corner protectors as needed. The corner protectors are stack loaded at the station 51 and then the stacks are moved laterally (to the right in FIG. 3) into position for picking by the robotic arms 42.

An adhesive applicator 52 (e.g., a unit with one or more dispensing nozzles) is also located on each side of the conveyor 44 in a position that permits adhesive to be applied to corner protectors 50 when the robotic arm 42 picks and holds the corner protector in proximity to the adhesive applicator 52. In one embodiment, the adhesive applicator outputs a hot melt glue, but other adhesives could potentially be used.

The sequence of operation of corner protector placement is now described primarily with reference to FIGS. 3, 5, 6 and 7. Palletized loads are conveyed by conveyor 44 from left to right into the wrapping station 10. When a palletized load reaches an initial corner protector placement location, represented by pallet load 60A, conveyance of the palletized load is stopped. The conveyor 44 may be equipped with a mechanical of visual sensor that is tripped by the load to indicate the presence of the load at the initial corner protector placement location. Each robotic arm then moves over its respective corner protector supply 48, picks a corner protector and repositions the corner protector into a vertical orientation as the corner protector is moved toward the palletized load. Each robotic arm the positions and holds the corner protector (e.g., via vacuum cups 62) at the exterior side of the angle member, with the inside corner of the protector faxing toward the palletized load as represented in FIG. 6A. During this initial positioning operation the corner edge detection system 64 on the robotic arm is used to search for and identify the location of its respective downstream corner of the palletized load. The control system associated with the robotic arm stores the identified corner location for later use.

Figure 6A:
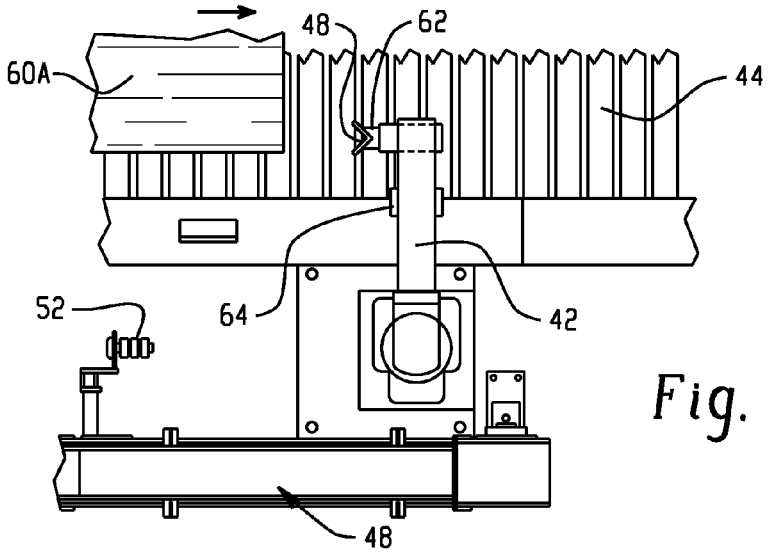
FIGS. 6A-6C show a sequence of corner protector placement on a downstream corner edge of a palletized load.
Figure 6B:
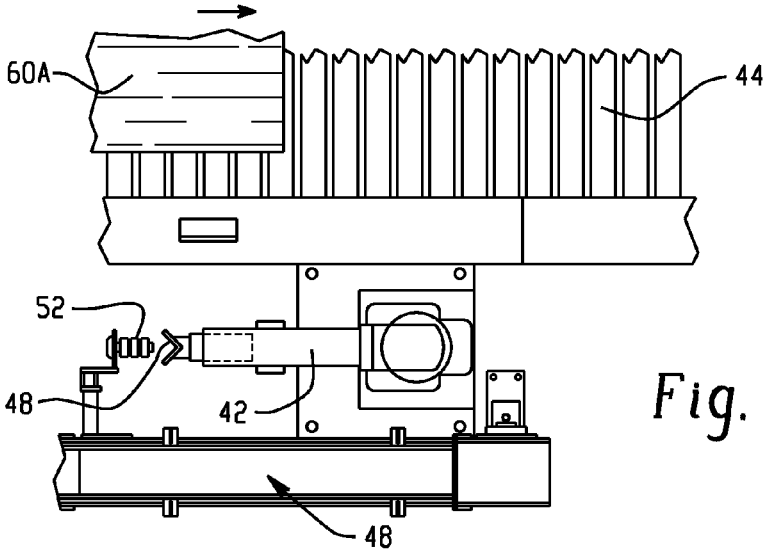

The robotic arm 42 then moves the corner protector 48 into position adjacent the adhesive applicator 52 as shown in FIG. 6B. The applicator 52 is operated to output adhesive to the inside corner surfaces of the protector 48. In one example, multiple horizontal strips of adhesive may be applied, in which case the opening and closing of the applicator nozzle is coordinated with vertical positioning of the protector 48 at desired locations for the horizontal glue strip. The protector 48 may be moved laterally past the nozzle of the applicator 52 during the application process. In other embodiments, the adhesive could be applied in vertical strips or dots.

Figure 6C:
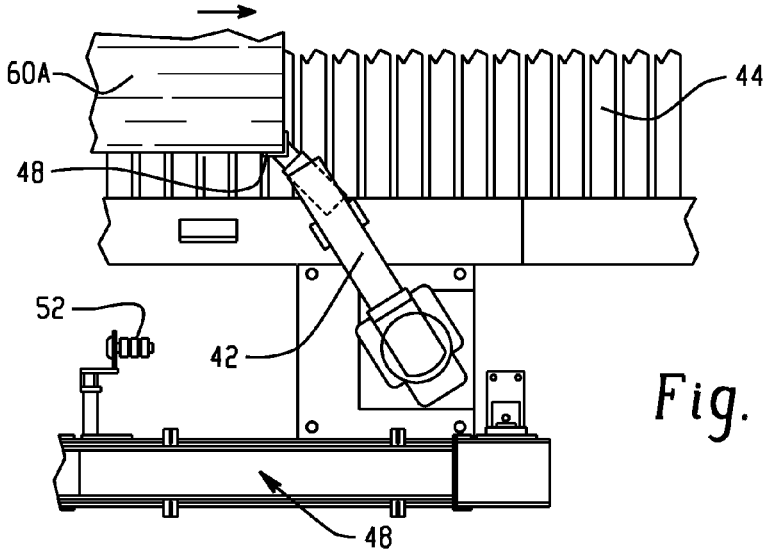
Figure 7A:
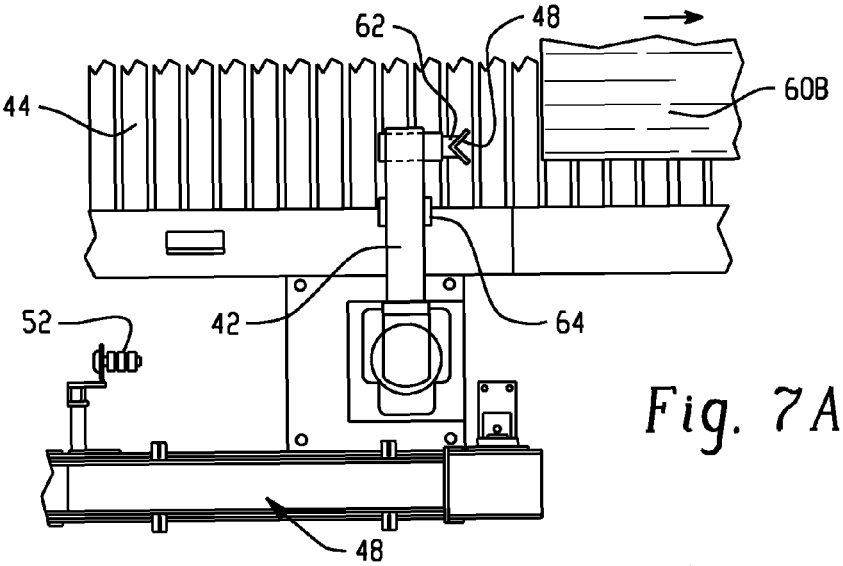
FIGS. 7A-7C show a sequence of corner protector placement on an upstream corner of a palletized load.
Figure 7B:
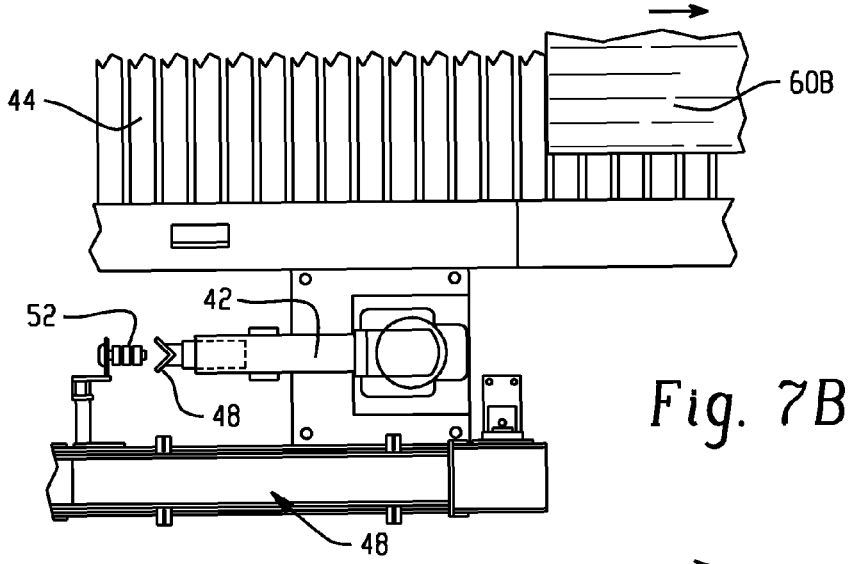
Figure 7C:
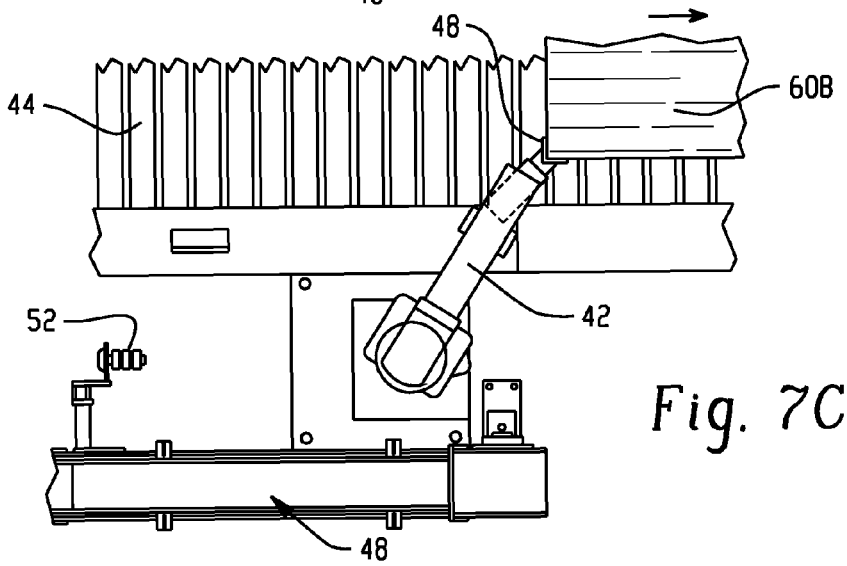

Once the adhesive is applied, the robotic arm 42 then moves the protector back toward the palletized load and presses the protector 48 against the vertical corner edge of the palletized load, as shown in FIG. 6C. The protector is momentarily (e.g., several seconds or less) held in place by the arm 42 to assure good adhesion of the protector 48 to the vertical corner of the load. The corner protector is then released by the arm 42, the arm is moved away from the palletized load and the conveyor 44 is operated to move the palletized load into another corner protector placement location represented by downstream load 60B.

When the palletized load reaches the downstream corner placement location 60B, the conveyor 44 is stopped. A corner protector placement sequence is then initiated and proceeds similar to that described above with respect to FIGS. 6A-6C. The sequence of placement of the protectors on the downstream vertical corner edges of the load is depicted schematically in FIGS. 7A-7C.

While FIGS. 6A-6C and FIGS. 7A-7C show operation of a single one of the robotic arms 42, normally the operation of both arms overlaps to apply corner protectors to the corners on both sides of the palletized load. In one embodiment, the operation of the two robotic arms 42 is substantially synchronized so that similar steps take place at the same time on the opposite sides of the conveyor and load.

Once all four corner protectors have been placed, the conveyor 42 is operated to move the palletized load, with corner protectors adhered thereto, on toward the wrapping station for wrapping of the stretch film as described above. In this process, the corner protectors are held in place by the adhesive and there is no need to apply any positive mechanical action to hold the corner protectors in place during the stretch film wrapping sequence. Moreover, when one palletized load is being wrapped at the wrapping station, corner protectors can be applied to an upstream palletized load simultaneously to help increase throughput of the system.

Referring again to FIG. 1, the control system for the wrapping system may include robotic controller (e.g., FANUC R 30iA Mate Controllers) housed in an electronics rack housing 70 and a glue controller housed in an electronics housing 72, along with controllers for the conveyor 44 and wrapping station components, all of which are interconnected to enable coordinated operation of the various system components.

It is to be clearly understood that the above description is intended by way of illustration and example only and is not intended to be taken by way of limitation, and that changes and modifications are possible.

What is claimed is:

1. A method of applying corner protectors to a palletized load, comprising:

(a) locating a corner protector placement station upstream of a film wrapping station;

(b) moving a palletized load into the corner protector placement station where a corner protector is applied to each corner of the palletized load and secured thereto via an adhesive; and (c) moving the palletized load with corner protectors adhered thereto out of the corner protector placement station and toward the film wrapping station;

wherein step (b) involves:

(b1) moving the palletized load into a first corner protector placement location and:

(i) using a first robotic arm to identify a first downstream corner edge of the palletized load, position a first corner protector proximate a first adhesive applicator as adhesive is applied to the first corner protector and move the first corner protector with applied adhesive into contact with the identified first downstream corner edge of the palletized load;

(ii) using a second robotic arm to identify a second downstream corner edge of the palletized load, position a second corner protector proximate a second adhesive applicator as adhesive is applied to the second corner protector and move the second corner protector with applied adhesive into contact with the identified second downstream corner edge of the palletized load;

(b2) subsequent to step (b1), moving the palletized load into a second corner protector placement location that is downstream of the first corner protector placement location and:

(i) using the first robotic arm to identify a first upstream corner edge of the palletized load, position a third corner protector proximate the first adhesive applicator as adhesive is applied to the third corner protector and move the third corner protector with applied adhesive into contact with the identified first upstream corner edge of the palletized load;

(ii) using the second robotic arm to identify a second upstream corner edge of the palletized load, position a fourth corner protector proximate the second adhesive applicator as adhesive is applied to the fourth corner protector and move the fourth corner protector with applied adhesive into contact with the identified second upstream corner edge of the palletized load.

2. The method of claim 1 wherein:

step (b1)(i) takes place substantially simultaneously with step (b1)(ii); and step (b2)(i) takes place substantially simultaneously with step (b2)(ii).

3. The method of claim 1 wherein the adhesive is a hot melt glue.

4. The method of claim 1 wherein step (a) and/or step (b) and/or step (c) take place while another palletized load is being wrapped in film at the film wrapping station.

5. A method of wrapping a palletized load, comprising:

(a) locating a corner protector placement station upstream of a film wrapping station;

(b) automatically moving a palletized load into the corner protector placement station where a corner protector is automatically applied to each corner of the palletized load and secured thereto via an adhesive;

(c) automatically moving the palletized load with corner protectors adhered thereto out of the corner protector placement station and toward the film wrapping station; and (d) automatically wrapping the palletized load with corner protectors adhered thereto in film at the film wrapping station, including wrapping film about both the product load and the protectors;

wherein step (b) involves:

(b1) moving the palletized load into a first corner protector placement location and:

(i) using a first robotic arm to identify a first downstream corner edge of the palletized load, position a first corner protector proximate a first adhesive applicator as adhesive is applied to the first corner protector and move the first corner protector with applied adhesive into contact with the identified first downstream corner edge of the palletized load;

(ii) using a second robotic arm to identify a second downstream corner edge of the palletized load, position a second corner protector proximate a second adhesive applicator as adhesive is applied to the second corner protector and move the second corner protector with applied adhesive into contact with the identified second downstream corner edge of the palletized load;

(b2) subsequent to step (b1), moving the palletized load into a second corner protector placement location that is downstream of the first corner protector placement location and:

(i) using the first robotic arm to identify a first upstream corner edge of the palletized load, position a third corner protector proximate the first adhesive applicator as adhesive is applied to the third corner protector and move the third corner protector with applied adhesive into contact with the identified first upstream corner edge of the palletized load;

(ii) using the second robotic arm to identify a second upstream corner edge of the palletized load, position a fourth corner protector proximate the second adhesive applicator as adhesive is applied to the fourth corner protector and move the fourth corner protector with applied adhesive into contact with the identified second upstream corner edge of the palletized load.

6. The method of claim 5 wherein:

step (b1)(i) takes place substantially simultaneously with step (b1)(ii); and step (b2)(i) takes place substantially simultaneously with step (b2)(ii).

7. The method of claim 5 wherein the adhesive is a hot melt glue.

8. The method of claim 5 wherein step (a) and/or step (b) and/or step (c) take place while another palletized load is being wrapped in film at the film wrapping station.

9. A method of applying corner protectors to a palletized load, comprising:

(a) utilizing a corner protector placement station upstream of a film wrapping station;

(b) automatically conveying a palletized load along a conveyance path into the corner protector placement station where a corner protector is automatically applied to each corner of the palletized load and secured thereto via an adhesive; and (c) automatically conveying the palletized load with corner protectors adhered thereto out of the corner protector placement station and toward the film wrapping station;

wherein step (b) involves:

(b1) automatically conveying the palletized load into a first corner protector placement location and:

(i) a first automated robotic arm identifies a first downstream corner edge of the palletized load, positions a first corner protector proximate a first adhesive applicator as adhesive is applied to the first corner protector and moves the first corner protector with applied adhesive into contact with the identified first downstream corner edge of the palletized load;

(ii) a second auatomated robotic arm identifies a second downstream corner edge of the palletized load, positions a second corner protector proximate a second adhesive applicator as adhesive is applied to the second corner protector and moves the second corner protector with applied adhesive into contact with the identified second downstream corner edge of the palletized load;

(b2) subsequent to step (b1), automatically conveying the palletized load into a second corner protector placement location that is downstream of the first corner protector placement location and:

(i) the first robotic arm identifies a first upstream corner edge of the palletized load, positions a third corner protector proximate the first adhesive applicator as adhesive is applied to the third corner protector and moves the third corner protector with applied adhesive into contact with the identified first upstream corner edge of the palletized load;

(ii) the second robotic arm identifies a second upstream corner edge of the palletized load, positions a fourth corner protector proximate the second adhesive applicator as adhesive is applied to the fourth corner protector and moves the fourth corner protector with applied adhesive into contact with the identified second upstream corner edge of the palletized load.

10. The method of claim 9 wherein:

step (b1)(i) takes place substantially simultaneously with step (b1)(ii); and step (b2)(i) takes place substantially simultaneously with step (b2)(ii).

11. The method of claim 9 wherein step (a) and/or step (b) and/or step (c) take place while another palletized load is being wrapped in film at the film wrapping station.

12. The method of claim 9, wherein:

the first robotic arm includes a detection apparatus;

the second robotic arm includes a detection apparatus; and a control system is configured to control the conveying system, first robotic arm, second robotic arm, first adhesive applicator and second adhesive applicator to carry out steps (b)(1) and (b)(2).

* * * * *